US006098481A

United States Patent [19]

Mills et al.

[11] Patent Number: 6,098,481

[45] Date of Patent: Aug. 8, 2000

[54] HIGH FORCE VARIABLE POSITION DETENT MECHANISM

[75] Inventors: Rudy V. Mills, Crest Hill; David P. Smith, Joliet, both of Ill.

[73] Assignee: Caterpillar Inc., Peoria, Ill.

[21] Appl. No.: 09/212,026

[22] Filed: Dec. 15, 1998

[51] Int. Cl.[7] ..... G05G 9/00; G05G 5/06

[52] U.S. Cl. ..... 74/471 XY; 74/531; 74/527

[58] Field of Search ..... 74/471 XY, 527, 74/531, 483 R; 244/223, 234; 335/207; 361/143, 144, 160, 206; 200/338

[56] References Cited

U.S. PATENT DOCUMENTS

| | | | |
|---|---|---|---|
| 3,556,270 | 1/1971 | Comment | 192/3 |
| 4,103,559 | 8/1978 | Kohler | 74/471 XY |
| 5,062,509 | 11/1991 | Carpenter et al. | 74/483 R |
| 5,309,783 | 5/1994 | Doolittle et al. | 74/531 X |
| 5,522,277 | 6/1996 | Bollinger | 74/531 |
| 5,809,841 | 9/1998 | Smith | 74/531 |

OTHER PUBLICATIONS

U.S. Patent Application Serial No. 08/822,391, Filed Mar. 20, 1997, entitled "Operator Controlled Electrical Output Signal Device".

*Primary Examiner*—David A. Bucci
*Assistant Examiner*—Colby Hansen
*Attorney, Agent, or Firm*—J. W. Burrows

[57] ABSTRACT

A high force detent mechanism to selectively hold a control input lever in any selected position between neutral and its maximum travel in either direction. The high force detent mechanism includes a coil assembly connected to a control input lever and disposed in close proximity to a semi-circular member having a serrated edge defined thereon. An armature of the coil assembly has a first portion in driving contact with the serrated edge and a second enlarge portion having a latching surface disposed adjacent one of the first and second end faces of the coil assembly's detent coil. The size of the latching surface is larger than the size of the first portion that is in driving contact with the serrated edge. Consequently, the latching force generated between the latching surface and the one face of the detent coil is multiplied several time to create a detent holding force that is larger than the latching force.

8 Claims, 2 Drawing Sheets

HIGH FORCE VARIABLE POSITION DETENT MECHANISM

TECHNICAL FIELD

This invention relates generally to a detent mechanism and more particularly to a high force variable position detent mechanism capable of maintaining a control lever or the like in an infinite number of positions while maintaining low lever input efforts needed for fine modulation and which can be turned on/off or infinitely varied electrically for various feel modes.

BACKGROUND ART

Control levers are commonly used on machines to provide an input by an operator to perform desired functions on the machine. Typically, movement of the control lever is in a fore and aft direction or possibly a side to side direction. These levers are normally spring biased to return to the neutral position when the operator releases the lever. It is desirable to keep the spring bias forces as low as possible in order to keep operator fatigue low. In many machines it is also desirable to provide a detent arrangement to hold the lever at any desired position. Many known detents are mechanical type detents that function to hold the lever in a single position. It is also known to use electrically actuated solenoids to provide a holding force to selectively hold the lever at any desired position. These have proven to be helpful but in some situations the holding force is not sufficient to hold the lever at the desired position when the machine is being subjected to rough terrain. The "jolting" of the machine may cause the lever to inadvertently or gradually move due to the machine's movement or due to the placement of the lever on the machine. Additionally, many times the operator may rest his hand on the lever while it is in the detented position and the weight of the operator's hand and/or the motion of the machine may cause the lever to inadvertently move. It is desirable to provide a high force detent mechanism that will more effectively hold an input lever in the desired detented position without incorporating bulky arrangements or increasing lever efforts. It is also desirable to provide such a high force detent mechanism that is usable in a joystick control.

The present invention is directed to overcoming one or more of the problems as set forth above.

DISCLOSURE OF THE INVENTION

In one aspect of the present invention a high force detent mechanism is provided and adapted for use with a control input lever connected to a support for pivotal movement about a pivot. The high force detent mechanism includes a semi-circular member connected to the support and having an axis coinciding with the pivotal movement of the control lever and a coil assembly connected to the control input lever. A serrated edge is disposed on the semi-circular member parallel with the axis of the control lever. The coil assembly has a detent coil with an armature disposed therein. The detent coil includes first and second end faces and is connected to the control input lever. The armature has a first portion disposed in driving contact with the serrated edge of the semi-circular member and a second enlarged portion having a latching surface disposed adjacent one of the first and second end faces of the detent coil. The latching surface of the second enlarged portion is magnetically latched to the one of the first and second end faces when the coil assembly is energized.

BEST MODE FOR CARRYING OUT THE INVENTION

Figure 1:
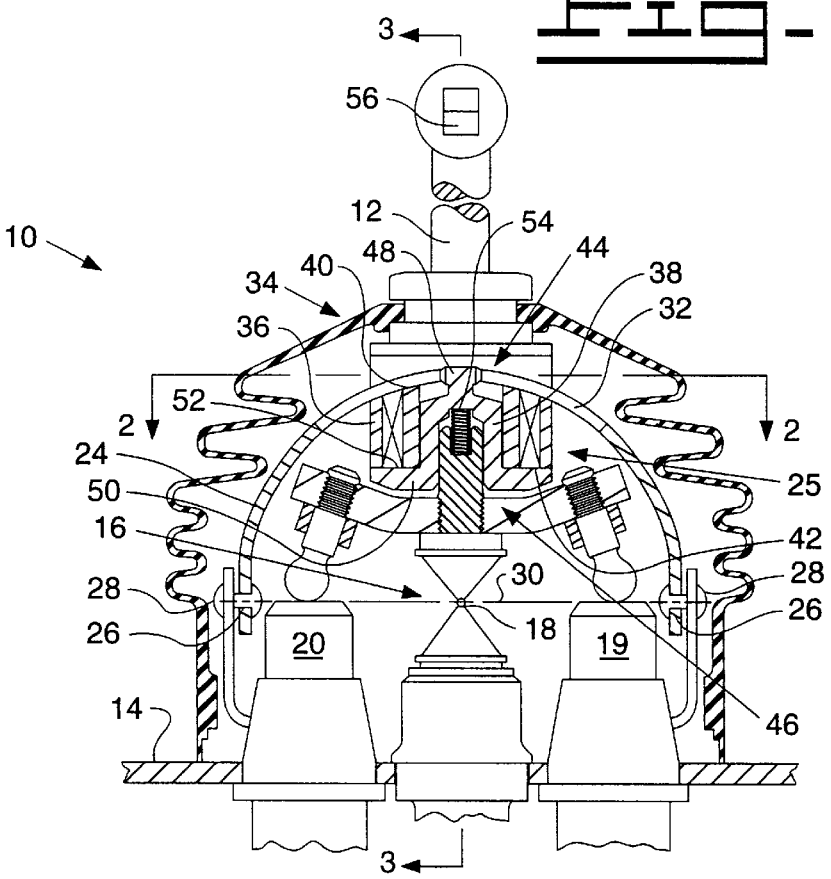
FIG. 1 is a side view of a diagrammatic representation of a lever input control arrangement incorporating the subject invention.

Referring to the drawings, a high force detent mechanism 10 is illustrated in combination with a control input lever 12 for retaining the control lever at an infinite number of actuated positions. The control input lever 12 in this embodiment is a joystick and is connected to a support 14 through a universal coupling 16 for pivotal movement about a pivot 18. The support 14 can be, for example, a component of a pilot valve or an electrical control having a plurality of plungers, two of which are shown at 19,20 extending through the support on opposite sides of the universal coupling 16. The other two plungers 21,22 associated with the joystick are typically located at 90 degrees from the plungers 19,20 and actuated in response to the control input lever 12 being moved through a second transverse axis. The plungers 19,20,21,22 are spring biased to the position shown for centering the control lever 12 at a neutral position.

Figure 2:
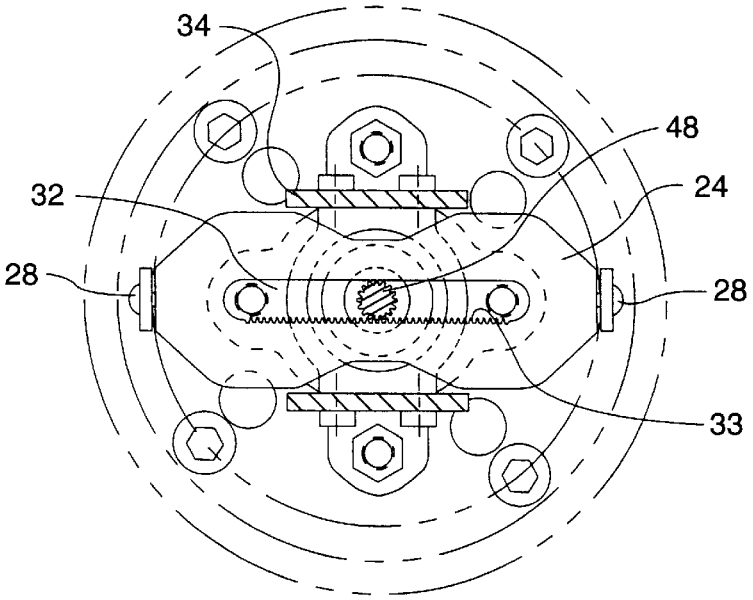
FIG. 2 is a top view of the lever input control arrangement of FIG. 1 taken along the line 2—2.
Figure 3:
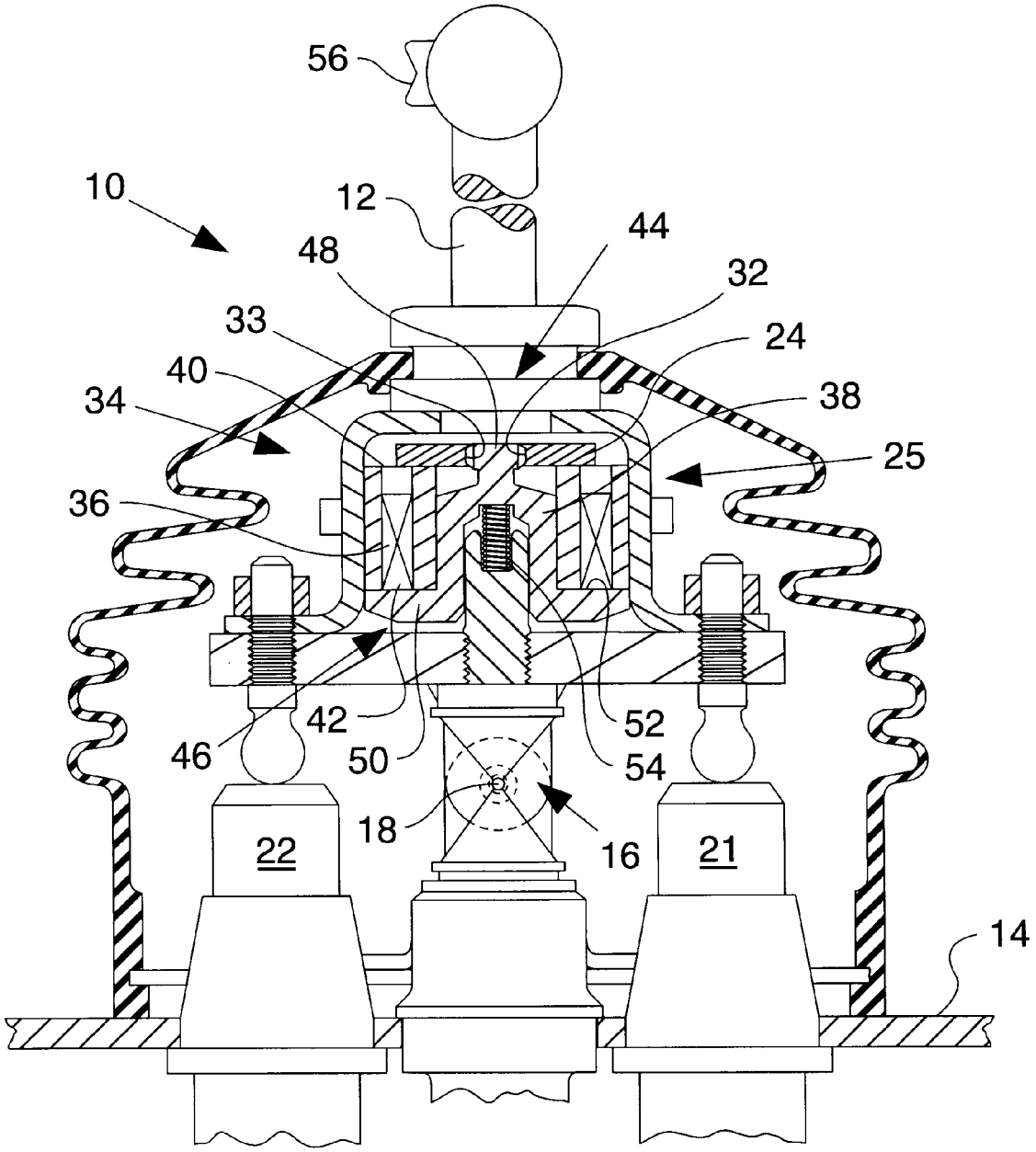
FIG. 3 is a front view of the lever input control arrangement of FIG. 1 taken along the line 3—3.

The high force detent mechanism 10 includes a semi-circular member 24 and a coil assembly 25. The semi-circular member 24 has opposite ends 26 pivotally connected to the support 14 with a pair of axially aligned pivot pins 28 having an axis 30 passing through the pivot 18. As more clearly shown in FIG. 2, the semi-circular member 24 has a slot 32 defined therein extending for a predetermined distance in both directions from the mid-point thereof towards the pivot pins 28. The slot 32 extends parallel with the pivotal movement of the control input lever 12. One edge of the extending slot 32 defines a serrated edge 33. The semi-circular member 24 varies in width from the mid-point thereof towards the respective pivot pins 28. The width of the semi-circular member 24 is the narrowest at the mid-point and the widest at a location adjacent the respective pivot pins 28.

A carrier assembly 34 is disposed between the control input lever 14 and the universal coupling 16. The semi-circular member 24 passes through a portion of the carrier member 34. The coil assembly 25 is connected to the carrier assembly 34 and disposed on the concave side of the semi-circular member 24. The coil assembly 25 includes a detent coil 36 and an armature 38 disposed within the detent coil 36. The detent coil 36 has first and second end faces 40,42. The first end face 40 is arcuate in shape and generally matches the arcuate shape of the semi-circular member 24. The first end face 40 is disposed adjacent the semi-circular member 34. When the coil assembly 25 is energized with electrical energy, the first end face 40 magnetically latches to the semi-circular member 34. The second end face 42 is generally flat and located opposite to the first end face 40.

The armature 38 has first and second portions 44,46. The first portion 44 includes a circular splined member 48 that meshes with the serrated edge 33. Therefore, the first portion 44 is disposed in driving contact with the serrated edge 33. The circular splined member 48 has a predetermined diameter. Any pivotal movement of the control input lever 12 in either direction results in rotational movement of the armature 38 due to the driving contact between the circular splined member 48 and the serrated edge 33.

The second portion 46 includes an enlarged portion 50 having a generally flat latching surface 52 disposed generally adjacent to the second end face of the detent coil 36.

When the coil assembly 25 is energized with electrical energy, the latching surface 52 magnetically latches with the second end face 42 of the detent coil 36 to create a latching force. A detent holding force is generated between the control input lever 12 and the semi-circular member 24. Since the latching surface 52 is larger than the diameter of the circular splined member 48, the detent holding force is larger than the latching force between the second end face 42 and the latching surface 52. Preferably, the detent holding force is at least four times greater than the latching force.

The latching surface 52 of the armature 38 is held adjacent to the second end face of the detent coil 36 by a biasing mechanism, such as a spring 54. A switch arrangement 56 is located on the control input lever 12 and operative to selectively energize and de-energize the coil assembly 25.

It is recognized that various alternatives could be utilized in the subject high force detent mechanism 10 without departing from the essence of the subject invention. For example, it is recognized that the first and second portions 44,46 of the armature 38 could be on the same end thereof. In this alternate arrangement, the first end face 40 of the detect coil 36 would not be adjacent the semi-circular member 24 and consequently would not latch to the semi-circular member 24 when the coil assembly 34 is electrically energized. Preferably, the first end face 40 of the detent coil 36 is located adjacent to the semi-circular member 24. The first end face 40 could be located on either side (concave or convex) of the semi-circular member 24. This effectively increases the detent holding force between the coil assembly 25 and the semi-circular member 24. Likewise, the switch arrangement 56 does not have to be located on the control input lever 12. A single axis lever can be configured with a semi-circular member 24 without the pivot mechanisms 26,28.

INDUSTRIAL APPLICABILITY

In use, the coil assembly 25 is energized in a well known manner by closing the switch arrangement 56 to direct electrical energy to the coil assembly 25. Energizing the coil assembly 25 creates an electromagnetic field to simultaneously, magnetically latch the first end face 40 of the detent coil 36 to the semi-circular member 24 and the second end face 42 thereof to the latching surface 52 of the armature 38. A first latching force is created by the latching of the first end face 40 to the semi-circular member 24 and a second latching force is created by the latching of the second end face 42 to the latching surface 52. The first latching force is a variable latching force since the width of the semi-circular member 24 varies. This is true since the first end face 40 of the detent coil 36 is wider than the width of the narrowest portion of the semi-circular member 24. The first latching force is the greatest when the first end face 40 is located at the widest portion of the semi-circular member 24.

The second latching force is substantially larger than the first latching force. Since the second latching force is mechanically multiplied by the size relationship between the latching surface 52 and the diameter of the circular splined member 48, the resulting detent holding force is several times larger than the second latching force. In the subject arrangement, the detent holding force is at least four times greater than the second latching force and preferably about ten times greater. It is recognized that this relationship can be easily changed to meet changing requirements. It is also recognized that the total detent latching force could also be changed by changing the magnitude of the electrical energy being directed to the coil assembly 25.

In view of the foregoing, it is readily apparent that the structure of the present invention provides a high force detent mechanism 10 that permits selective control of the detent mechanism with high detent forces being created with smaller coil assemblies. By utilizing a mechanical force multiplier to increase the detent latching force, a simple and effective detent arrangement is provided.

Other aspects, objects and advantages of this invention can be obtained from a study of the drawings, the disclosure and the appended claims.

What is claimed is:

1. A high force detent mechanism comprising:

a semi-circular member connected to a support and having an axis coinciding with the pivotal movement of a control lever, a serrated edge disposed on the semi-circular member parallel with the axis of the control lever;

a coil assembly having a detent coil with an armature disposed therein, the detent coil having first and second end faces and being connected to the lever, the armature has a first portion disposed in driving contact with the serrated edge of the semi-circular member and a second enlarged portion having a latching surface disposed adjacent one of the first and second end faces of the detent coil to magnetically latch the latching surface of the second enlarged portion to the one of the first and second end faces when the coil assembly is energized.

2. The high force detent mechanism of claim 1 wherein the armature includes a circular splined member that meshes with the serrated edge of the semi-circular member and in response to movement of the control input lever induces rotational movement to the armature.

3. The high force detent mechanism of claim 2 wherein the circular splined member has a predetermined cross-sectional diameter, when the coil assembly is energized a latching force is generated between the latching surface of the enlarged portion and the one of the first and second end faces of the detent coil to establish a detent holding force between the circular splined member and the serrated edge in the order of at least four times greater than that of the latching force.

4. The high force detent mechanism of claim 3 wherein the first end face of the detent coil is disposed adjacent the semi-circular member and the latching surface of the second enlarged portion of the armature magnetically latches with the second end face of the detent coil.

5. The high force detent mechanism of claim 4 wherein the first end face of the detent coil magnetically latches the detent coil to the semi-circular member when the coil assembly is energized.

6. The high force detent mechanism of claim 5 wherein the latching surface of the armature is held in a position adjacent to the second end face of the detent coil by a biasing mechanism.

7. The high force detent mechanism of claim 6 wherein a switch is located on the control input lever to selectively or proportionally engage and disengage the coil assembly and the semi-circular member has a variable width.

8. The high force detent mechanism of claim 7 applied to a joystick control and the semi-circular member has opposite ends pivotally connected to the support so that the control input lever is selectively movable through a second transverse axis.

* * * * *